US006511780B1

(12) United States Patent
Veregin et al.

(10) Patent No.: US 6,511,780 B1
(45) Date of Patent: Jan. 28, 2003

(54) CARRIER PARTICLES

(75) Inventors: Richard P. N. Veregin, Mississauga (CA); Vladislav Skorokhod, Mississauga (CA); Michael S. Hawkins, Cambridge (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/917,588

(22) Filed: Jul. 30, 2001

(51) Int. Cl.[7] ..... G03G 9/00

(52) U.S. Cl. ..... 430/111.35; 430/111.4; 430/111.41

(58) Field of Search ..... 430/111.35, 111.4, 430/111.41

(56) References Cited

U.S. PATENT DOCUMENTS

| | | | | |
|---|---|---|---|---|
| 3,533,835 | A | 10/1970 | Hagenbach et al. | 117/217 |
| 3,590,000 | A | 6/1971 | Palermiti et al. | 252/62.1 |
| 3,658,500 | A | 4/1972 | Hagenbach | 65/21 |
| 3,798,167 | A | 3/1974 | Kukla et al. | 262/62.1 |
| 3,918,968 | A | 11/1975 | Kukla et al. | 96/1.5 D |
| 3,922,382 | A | 11/1975 | Kukla et al. | 427/58 |
| 3,939,086 | A | 2/1976 | Hagenbach | 252/62.1 P |
| 4,233,387 | A | 11/1980 | Mammino et al. | 430/137 |
| 4,238,558 | A | 12/1980 | Ziolo | 430/108 |
| 4,264,697 | A | 4/1981 | Perez et al. | 430/107 |
| 4,310,611 | A | 1/1982 | Miskinis | 430/107 |
| 4,397,935 | A | 8/1983 | Ciccarelli et al. | 430/110 |
| 4,546,060 | A | 10/1985 | Miskinis et al. | 430/108 |
| 4,764,445 | A | 8/1988 | Miskinis et al. | 430/108 |
| 4,855,205 | A | 8/1989 | Saha et al. | 430/106.6 |
| 4,855,206 | A | 8/1989 | Saha | 430/106.6 |
| 5,015,550 | A | 5/1991 | Creatura et al. | 430/108 |
| 5,236,629 | A | 8/1993 | Mahabadi et al. | 252/511 |
| 5,998,076 | A | 12/1999 | Mahabadi et al. | 430/106.6 |
| 6,004,712 | A | 12/1999 | Barbetta et al. | 430/108 |
| 6,051,354 | A | 4/2000 | Veregin et al. | 430/108 |

OTHER PUBLICATIONS

Copending application U.S. Ser. No. 09/037,555, filed Mar. 9, 1998, on "Carrier".

Copending application U.S. Ser. No. 09/640,601, filed Aug. 17, 2000, on "Coated Carriers".

Copending application U.S. Ser. No. 09/640,457, filed Aug. 17, 2000, on "Coated Carriers".

*Primary Examiner*—Mark A. Chapman
(74) *Attorney, Agent, or Firm*—E. O. Palazzo

(57) ABSTRACT

Carrier comprised of a mixture of insulating carrier particles and conductive carrier particles.

35 Claims, No Drawings

CARRIER PARTICLES

RELATED PATENTS AND COPENDING APPLICATIONS

Illustrated in copending application U.S. Ser. No. 09/037,555, and U.S. Pat. No. 5,998,076, the disclosures of which are totally incorporated herein by reference are, for example, a carrier comprised of a soft or hard magnetic core, a number of, or all of the pores thereof being filled with polymer, and thereover a coating and a carrier comprised of a porous hard magnetic core and wherein the pores thereof are filled with a polymer and which carrier contains a coating thereover of a polymer, or a polymer mixture. Also, illustrated in U.S. Pat. No. 6,004,712, the disclosure of which is totally incorporated herein by reference, are carriers, coated carriers, and developers thereof. The carrier coatings of the above application and patents may contain a conductive component, such as carbon black therein.

Illustrated in U.S. Pat. No. 6,358,659, the disclosure of which is totally incorporated herein by reference, is, for example, a carrier comprised of a core and thereover a polymer, and wherein the polymer contains a conductive polymer dispersed therein.

Illustrated in U.S. Pat. No. 6,391,509, the disclosure of which is totally incorporated herein by reference, is, for example, a carrier comprised of a core, a polymer coating and wherein the coating contains a conductive polymer.

The appropriate components of the above patents and copending applications may be selected for the present invention in embodiments thereof.

BACKGROUND OF THE INVENTION

This invention is generally directed to developer compositions, and more specifically, the present invention relates to developer compositions containing carriers. In embodiments of the present invention the carrier particles can be generated from a mixture of an insulating carrier and a conductive carrier inclusive of mixtures of coated insulating and coated conductive carriers, and wherein insulating refers, for example, to a conductivity of from about $10^{-13}$ to about $10^{-18}$ (ohm-cm)$^{-1}$, and conducting refers, for example, to conductivities of about $10^{5}$ to about $10^{-9}$ (ohm-cm)$^{-1}$. Thus, for example, there can be provided in accordance with aspects of the present invention carrier particles with a conductivity of from about $10^{-6}$ to about $10^{-15}$ (ohm-cm)$^{-1}$, and more specifically, wherein the carriers possess semiconductive characteristics, that is wherein the conductivity of the carrier particles are in between conductive and insulative carriers, and more specifically, wherein semiconductive refers, for example, to a carrier with a conductivity of from about $10^{-9}$ to about $10^{-13}$ (ohm-cm)$^{-1}$. The carriers of the present invention may be mixed with a toner of resin, colorant, and optional toner additives to provide developers that can be selected for the development of images in electrostatographic, especially xerographic, imaging systems, printing processes and digital systems.

Examples of conductive carriers are comprised, for example, of a carrier core and a polymer coating of, for example, polyacetylene, poly(p-phenylene), poly(p-phenylene sulfide), polyvinylenephenylene, poly(vinylene sulfide), polyaniline, polypyrrole, polythiophene and derivatives thereof, and a class of components with conjugated Π-electron backbones, which when oxidized or reduced with charge transfer agents, or dopants in suitable amounts of, for example, from about 0.1 to about 20 weight percent, can convert an insulating polymer to a conductive polymer. The electrical conductivity of the conducting polymer is usually measured using a 4 point probe according to ASTM-257, and which conductivity can vary widely depending, for example, primarily on the oxidizing or reducing power of the dopant. Conductivities of about 1,100 (ohm-cm)$^{-1}$ have been reported for polyacetylene, 100 (ohm-cm)$^{-1}$ for polypyrrole and 10 (ohm-cm)$^{-1}$ for polythiophene with $AsF_6^-$ as the dopant ion. Using other doping agents, such as $BF_4^-$, $I_2$, $FeCl_4^-$, HCl, $ClO_4^-$, conductivities of from about 500 to about 7,500 (ohm-cm)$^{-1}$ S/cm have been reported for polypyrrole, 1,000 (ohm-cm)$^{-1}$ for polythiophene, about 1,000 to about 10,000 (ohm-cm)$^{-1}$ for poly(3-alkylthiophene) and 200 (ohm-cm)$^{-1}$ for polyaniline, however, many of the commercial polymer materials have conductivities between $10^{-12}$ and 100 (ohm-cm)$^{-1}$. Other doping agents include sulfuric acid, methanesulfonic acid, trifluoromethane sulfonic acid, benzenesulfonic acid, p-toluene sulfonic acid, p-ethylbenzene sulfonic acid, 1,3 benzenedisulfonic acid, 2-naphthalene sulfonic acid, 1,5 naphthalene sulfonic acid, 2-anthraquinone sulfonic acid. Conductive carriers can also include a carrier core, a polymer thereover and a conductive component, such as a conductive carbon black dispersed in the polymer coating.

Examples of insulating carriers include carriers comprised of a carrier core and a polymer thereover, such as polymethylmethacrylate (PMMA), polyvinylidenefluoride, polyethylene, copolyethylene vinylacetate, copolyvinylidenefluoride tetrafluoroethylene, polystyrene, polytetrafluoroethylene, polyvinylchloride, polyvinylfluoride, polylbutylacrylate, copolybutylacrylate methacrylate, polytrifluoroethylmethacrylate, and polyurethanes.

Advantages of the carriers of the present invention in embodiments include controlling and preselecting the triboelectric charge and conductivity of the carrier, the formation of homogenous mixtures, excellent carrier coating adherence, stable charging characteristics, carrier design flexibility and freedom, economical carrier formation, avoidance or minimization of two or more polymer coatings, excellent stable charging characteristics, and the like.

PRIOR ART

Developer compositions with coated carriers that contain conductive components like carbon black are known. Disadvantages associated with these prior art carriers may be that the carbon black can increase the brittleness of the polymer matrix, which causes the separation of the coating from the core, and thereby contaminates the toner and developer causing, for example, instabilities in the charging level of the developer as a function of a number of factors, such as the developer age in the xerographic housing and the average toner area coverage of a printed page, or instabilities in the color gamut of the developer set. In addition, with carbon black it is difficult to tune, or preselect the carrier conductivity. These and other disadvantages are avoided, or minimized with the carriers of the present invention in embodiments thereof.

The conductivity of carbon blacks is generally independent of the type of carbon black used, and in carbon black composites there is usually formed a filamentary network above a certain concentration, referred to as the "percolation" threshold. At concentrations of up to about 30 weight percent, conductivities of $10^{-2}$ (ohm-cm)$^{-1}$ have been reported. The resistivity thereof, measured with a standard 4-pin method according to ASTM-257, is observed to increase with decreasing carbon black concentration.

Carrier particles for use in the development of electrostatic latent images are illustrated in many patents including, for example, U.S. Pat. No. 3,590,000. These carrier particles may contain various cores, including steel, with a coating thereover of fluoropolymers, or terpolymers of styrene, methacrylate, and silane compounds. Recent efforts have focused on the attainment of coatings for carrier particles, for the primary purpose of improving development quality; and also to permit carrier particles that can be recycled, and which do not adversely effect the imaging member in any substantial manner. Some of the present commercial coatings can deteriorate, especially when selected for a continuous xerographic process where the entire coating may separate from the carrier core in the form of chips or flakes, and fail upon impact, or abrasive contact with machine parts and other carrier particles. These flakes or chips, which are not generally reclaimed from the developer mixture, can have an adverse effect on the triboelectric charging characteristics of the carrier particles thereby providing images with lower resolution in comparison to those compositions wherein entire carrier coatings are retained on the surface of the core substrate. Further, another problem encountered with some prior art carrier coatings resides in fluctuating triboelectric charging characteristics, particularly with changes in relative humidity. The aforementioned modifications in triboelectric charging characteristics provides developed images of lower quality, and with background deposits.

There is illustrated in U.S. Pat. No. 4,233,387, the disclosure of which is totally incorporated herein by reference, coated carrier components for electrostatographic developer mixtures comprised of finely divided toner particles clinging to the surface of the carrier particles. Specifically, there is disclosed in this patent coated carrier particles obtained by mixing carrier core particles of an average diameter of from between about 30 microns to about 1,000 microns, with from about 0.05 percent to about 3.0 percent by weight, based on the weight of the coated carrier particles, of thermoplastic resin particles. The resulting mixture is then dry blended until the thermoplastic resin particles adhere to the carrier core by mechanical impaction, and/or electrostatic attraction. Thereafter, the mixture is heated to a temperature of from about 320° F. to about 650° F. for a period of 20 minutes to about 120 minutes, enabling the thermoplastic resin particles to melt and fuse on the carrier core. While the developer and carrier particles prepared in accordance with the process of this patent, the disclosure of which has been totally incorporated herein by reference, are suitable for their intended purposes, the conductivity values of the resulting particles are not believed to be constant in all instances, for example, when a change in carrier coating weight is accomplished to achieve a modification of the triboelectric charging characteristics; and further with regard to the '387 patent, in many situations carrier and developer mixtures with only specific triboelectric charging values can be generated when certain conductivity values or characteristics are contemplated. With the invention of the present application, in embodiments thereof the conductivity of the resulting carrier particles are substantially constant, and moreover the triboelectric values can be selected to vary significantly, for example, from less than about 80 microcoulombs per gram to greater than about −80 microcoulombs per gram, depending on the polymer mixture selected for affecting the coating processes.

With further reference to the prior art, carriers obtained by applying insulating resinous coatings to porous metallic carrier cores using solution coating techniques are undesirable from many viewpoints. For example, insufficient coating material may be present, and therefore, is not as readily available for triboelectric charging when the coated carrier particles are mixed with finely divided toner particles. Attempts to resolve this problem by increasing the carrier coating weights, for example, to 3 percent or greater to provide a more effective triboelectric coating to the carrier particles necessarily involves handling excessive quantities of solvents, and further usually these processes result in low product yields. Also, solution coated carrier particles when combined and mixed with finely divided toner particles provide in some instances triboelectric charging values which are low for many uses. Powder coating processes have been utilized to overcome these disadvantages, and further to enable developer mixtures that are capable of generating high and useful triboelectric charging values with finely divided toner particles; and also wherein the carrier particles are of substantially constant conductivity. Further, when resin coated carrier particles are prepared by the powder coating process, the majority of the coating materials are fused to the carrier surface thereby reducing the number of toner impaction sites on the carrier material.

Powder coating processes typically utilize polymers in the form of fine powders which can be mixed and properly coat the carrier core. The triboelectric charging value of the aforementioned carriers can be controlled by the polymer or mixture of polymers selected for the coating. The disadvantage of this approach is that only a limited number of polymers are available in the form of fine powders, especially for the preparation of conductive carriers. Two approaches are known in the prior art for fabricating conductive carriers. First, conductive polymers which are in the form of fine powder can be utilized, for example, a conductive carbon black loaded polymer, reference U.S. Pat. No. 5,236,629, the disclosure of which is totally incorporated herein by reference. A second approach is to partially coat the carrier core with polymer. However, coatings prepared by this method have the tendency to chip or flake off, and fail upon impact, or abrasive contact with machine parts and other carrier particles. These flakes or chips, which cannot readily be reclaimed from the developer mixture, have an adverse effect on the triboelectric charging characteristics of the carrier particles, thereby providing images with lower resolution in comparison to those compositions wherein the carrier coatings are retained on the surface of the core substrate. Furthermore, partially coated carriers have a short life, for example from about 1 to about 30 days and poor stability.

Other patents of interest include U.S. Pat. No. 3,939,086, which illustrates steel carrier beads with polyethylene coatings, see column 6; U.S. Pat. No. 4,264,697, which discloses dry coating and fusing processes; U.S. Pat. Nos. 3,533,835; 3,658,500; 3,798,167; 3,918,968; 3,922,382; 4,238,558; 4,310,611; 4,397,935; 5,015,550; 5,002,846; 4,937,166, and 4,434,220.

Certain ferrite carriers are illustrated in U.S. Pat. Nos. 4,546,060, 4,764,445; 4,855,205, and 4,855,206. In the U.S. Pat. No. 4,855,205 patent there is disclosed a two phase ferrite composite with a spinel or S phase of the formula $MFe_2O_4$ and a magnetoplumbite or M phase, and which composite and magnetized. It is indicated in column 3 of this patent that the composites can be prepared by conventional procedures and that the composite can be coated with a polymer well known in the art. Examples of polymers include those as illustrated in U.S. Pat. No. 4,546,060, such as fluorocarbon polymers, like polytetrafluoroethylene, polyvinylidenefluoride, and the like, see column 8.

With respect to the prior art, only a small part thereof has been selected and this part may or may not be fully representative of the prior art teachings or disclosures.

The disclosures of each of the above patents are totally incorporated herein by reference. The appropriate carrier cores and polymer coatings of these patents may be selected for the present invention in embodiments thereof.

SUMMARY OF THE INVENTION

It is a feature of the present invention to provide toner and developer compositions with many of the advantages illustrated herein, and which carriers can be generated from a mixture of polymers.

In yet another feature of the present invention there are provided processes for generating carrier particle mixtures with a wide range of a preselected conductivity and a wide range of a preselected triboelectric charging values.

Yet another feature of the present invention is to provide conductive and insulative carrier particles that can be mixed in various proportions to achieve a carrier mixture with a selected desired conductivity for semiconductive carrier applications.

In yet a further feature of the present invention there are provided semiconductive carrier particles generated from a mixture of insulating carriers and conductive carriers, and wherein the conductive carrier coating can be generated from a monomer or monomers that, for example, are not in close proximity in the triboelectric series, that is for example, a mixture of monomers from different positions in the triboelectric series, and wherein the resulting coating has incorporated therein, or present therein or thereon a conductive component like a conductive carbon black, such as VULCAN carbon black available from Cabot Corporation.

In still a further feature of the present invention there are provided carrier particles with improved mechanical characteristics, carriers wherein the conductivity thereof is tunable by, for example, adjusting the concentration or amount of insulating and conductive carriers in the mixture and carriers wherein the coating adheres to the core and wherein there is minimal or no separation of the polymer coating from the core.

In yet another feature of the present invention there are provided heterogeneous semiconductive carrier compositions comprised of insulating and conductive carriers, and wherein the carrier core is, for example, a metallic or metal oxide core.

Further, in an additional feature of the present invention there are provided carrier particles wherein the carrier triboelectric charging values are from about 25 to about 70 microcoulombs per gram at the same coating weight as determined by the known Faraday Cage technique.

Aspects of the present invention relate to carrier comprised of a mixture of insulating carrier particles and conductive carrier particles; carrier comprised of a mixture of insulating coated carrier and a conductive coated carrier; a carrier wherein the mixture is a homogenous mixture; a carrier mixture wherein each of the carriers are coated with a polymer, or wherein each of the carriers is coated with a mixture of polymers; a carrier wherein the insulating or the conductive particles contain a coating; a carrier wherein the carrier mixture is comprised of from about 2 polymers to about 7 polymers, and wherein the mixture is comprised of from 1 to about 4 insulating coated carriers, and from 1 to about 4 of conductive coated carriers; a carrier wherein the conductive carrier polymer is a polyaniline; a carrier wherein the insulating carrier has a conductivity of about $10^{-13}$ to about $10^{-18}$ (ohm-cm)$^{-1}$; a carrier wherein the insulating carrier has a conductivity of about $10^{-13}$ to about $10^{-15}$ (ohm-cm)$^{-1}$; a carrier wherein the conducting carrier has a conductivity of about $10^{-5}$ to about $10^{-9}$ (ohm-cm)$^{-1}$; a carrier wherein the insulating carrier has a conductivity of about $10^{-13}$ to about $10^{-18}$ (ohm-cm)$^{-1}$, and the conducting carrier has a conductivity of about $10^{-5}$ to about $10^{-9}$ (ohm-cm)$^{-1}$; a carrier wherein the insulating carrier has a conductivity of about $10^{-13}$ to about $10^{-15}$ (ohm-cm)$^{-1}$, and the conducting carrier has a conductivity of about $10^{-5}$ to about $10^{-9}$ (ohm-cm)$^{-1}$; a carrier wherein the insulating carrier is comprised of a core and an insulating polymer thereover, and wherein optionally the insulating carrier has a conductivity of from about 10–13 to about $10^{-18}$ (ohm-cm)$^{-1}$, and wherein the conductive carrier is comprised of a core and a conductive polymer thereover, and wherein optionally the conductive carrier has a conductivity of from about $10^{-5}$ to about $10^{-9}$ (ohm-cm)$^{-1}$; a carrier wherein the insulating polymer is polymethylmethacrylate, polyvinylidenefluoride, polyvinylfluoride, copolybutylacrylate methacrylate, copolyperfluorooctylethyl methacrylate methylmethacrylate, or polystyrene, and optionally wherein the coating contains a conductive filler component; a carrier wherein the conducting carrier is comprised of a core, a polymer thereover and a conductive component; a carrier wherein the conductive component is a conductive carbon black, optionally present in an amount of from about 20 to about 70 weight percent, or wherein the conductive component is a metal oxide, a metal, a conductive polymer, or a semiconductor component; a carrier wherein the insulating polymer is polymethylmethacrylate, and wherein the core is a ferrite, powdered iron, or magnetite; a carrier wherein the carrier core for the insulating carrier is a ferrite and the carrier core for the conductive carrier is a magnetite; a carrier wherein in the carrier mixture there is present from about 5 to about 95 percent of the insulating carrier and from about 5 to about 95 percent of the conductive carrier, and wherein the total thereof is about 100 percent, or wherein in the mixture there is present from about 35 to about 75 percent of insulating carrier and from about 35 to about 75 percent of conductive carrier, and wherein the total thereof is about 100 percent; a carrier wherein in the mixture there is present from about 40 to about 60 percent of the insulating carrier particles and from about 40 to about 60 percent of the conductive carrier particles, and wherein the total thereof is about 100 percent, and wherein the carrier contains a core that is coated with a polymer, and wherein the polymer encompasses from about 75 to about 100 percent of the core; a carrier wherein the resulting carrier is semiconductive, and wherein the conductivity of the resulting carrier has a value of about $10^{-9}$ to about $10^{-13}$ (ohm-cm)$^{-1}$; a process for the preparation of a carrier which comprises the mixing of a carrier with insulating characteristics and a carrier with conductive characteristics, and wherein the carriers are comprised of a core and a polymer thereover, and wherein one of the carriers contains dispersed in the polymer coating a conductive component; a process wherein the monomer to form the polymer is selected from the group consisting of acrylic acid, methyl acrylate, ethyl acrylate, n-butyl acrylate, isobutyl acrylate, dodecyl acrylate, n-octyl acrylate, 2-chloroethyl acrylate, phenyl acrylate, methylalphachloracrylate, methacrylic acids, methyl methacrylate, ethyl methacrylate, butyl methacrylate, octyl methacrylate, acrylonitrile, methacrylonitrile and acrylamide; maleic acid, monobutyl maleate, dibutyl maleate; vinyl chloride, vinyl bromide, vinyl fluoride, vinyl acetate and vinyl benzoate; vinylidene chloride; pentafluoro styrene, allyl pentafluorobenzene, N-vinyl pyrrole, and trifluoroethyl methacrylate; and mixtures thereof; and wherein the monomer is present in an amount of from about 1 to about 5 percent by weight of the carrier core, or wherein the monomer is methyl methacrylate, styrene, trifluoroethyl methacrylate, or mixtures thereof, and wherein the monomer is present in an amount of from about 0.5 to about 10 percent by weight, or from about 1 to about 5 percent by weight of the carrier core, and where the amount of the conductive polymer additive present is from about 10 to about 70 percent by weight, or from about 20 to about 50 percent by weight of the monomer mixture, and wherein the initiator for polymerization of the monomer is selected from the group consisting of azo compounds, peroxides, and mixtures thereof, and where the amount of the initiator is from about 0.1 to about 20 percent by weight, or from about 0.5 to about 10 percent by weight of the monomer mixture; a carrier wherein the carries contain a core of a diameter of from about 30 to about 100 microns; a carrier wherein the conductive coating polymer coating is polyvinylidenefluoride, polyethylene, polymethylmethacrylate, polytrifluoroethylmethacrylate, copolyethylene vinylacetate, copolyvinylidenefluoride, tetrafluoroethylene, polystyrene, tetrafluoroethylene, polyvinyl chloride, polyvinyl acetate, or mixtures thereof, and optionally wherein the coating contains a conductive filler component; a carrier wherein each of the polymer coatings is present in a total amount of from about 0.5 to about 10 percent by weight of the carrier, or from about 1 to about 5 percent by weight of the carrier, and optionally wherein there results a semiconductive carrier with a conductivity of about $10^{-9}$ to about $10^{-13}$ (ohm-cm)$^{-1}$; a developer comprised of the carrier mixture illustrated herein and toner; a carrier wherein the insulating coated carrier contains a polymer coating of polymethylmethacrylate, polystyrene, polytrifluoroethylmethacrylate, polyvinylidene fluoride, or mixtures thereof, or wherein the insulating coated carrier comprises a polymer coating comprised of a mixture of polymethylmethacrylate and polytrifluoroethylmethacrylate; heterogeneous carrier compositions comprised of a mixture of an insulating carrier and a conductive carrier, wherein the amount of insulating carrier selected is, for example, from about 1 to about 99, and more specially, from about 35 to about 75 weight percent, and the amount of conductive carrier selected is, for example, from about 1 to about 99, and more specifically, from about 35 to about 75 weight percent, and wherein the amount of the insulating carrier and the amount of the conductive carrier totals, about 100 percent; a carrier composition wherein the core diameter is about 30 to about 100 microns as measured by a Malvern laser diffractometer; a carrier composition wherein the core is iron, steel or a ferrite, such as an iron ferrite, strontium ferrite, and the like; a carrier composition wherein the coating contains a doped conductive polymer, or a polymer of, for example, a vinyl polymer or a condensation polymer; a carrier composition wherein the polymer coating for the insulating carrier is a polystyrene, polyvinylidenefluoride, polyethylene, polymethylmethacrylate, polytrifluoroethylmethacrylate, copolyethylene vinylacetate, copolyvinylidenefluoride, tetrafluoroethylene, polystyrene, tetrafluoroethylene, polyvinyl chloride, polyvinyl acetate, polyvinyl acetate, or mixtures thereof, for example from about 1 to about 99 parts of a first coating and from about 99 to about 1 of a second coating, and wherein the total thereof is about 100 percent, and wherein the polymer coating is present in a amount of from about 0.5 to about 99 percent by weight of the carrier; wherein the conductive component is present in an amount of from about 10 to about 70 percent by weight of the polymer coating; wherein the conductive component is present in an amount of from about 20 to about 50 percent by weight of the polymer coating; a carrier composition containing a carrier with a conductivity of from about $10^{-15}$ to about $10^{-6}$ (ohm-cm)$^{-1}$; a carrier mixture with a triboelectric charge value of from about −80 to about 80 microcoulombs/gram and a semiconductivity of from about $10^{-12}$ to about $10^{-9}$ (ohm-cm)$^{-1}$; a process for the preparation of carriers comprising the mixing of carrier core with a monomer and initiator, optional chain transfer agent, and optional crosslinking agent; polymerizing the monomer by heating thereby resulting in a polymer contained on the carrier surface, and thereafter for the conductive carrier adding a conductive component, and optionally drying; a process wherein a monomer mixture is heated at a temperature from about 50° C. to about 95° C., or from about 60° C. to about 85° C.; a process wherein the monomer mixture is heated for a period of from about 30 minutes to about 5 hours, or from about 30 minutes to about 3 hours; a process wherein the monomer is selected from the group consisting of styrene, α-methyl styrene, p-chlorostyrene, monocarboxylic acids and the derivatives thereof; dicarboxylic acids with a double bond and derivatives thereof; vinyl ketones; vinyl naphthalene; unsaturated mono-olefins; vinylidene halides; N-vinyl compounds; fluorinated vinyl compounds; and mixtures thereof; a process wherein the monomer is selected from the group consisting of acrylic acid, methyl acrylate, ethyl acrylate, n-butyl acrylate, isobutyl acrylate, dodecyl acrylate, n-octyl acrylate, 2-chloroethyl acrylate, phenyl acrylate, methylalphachloracrylate, methacrylic acids, methyl methacrylate, ethyl methacrylate, butyl methacrylate, octyl methacrylate, acrylonitrile, methacrylonitrile and acrylamide; maleic acid, monobutyl maleate, dibutyl maleate; vinyl chloride, vinyl bromide, vinyl fluoride, vinyl acetate and vinyl benzoate; vinylidene chloride; pentafluoro styrene, allyl pentafluorobenzene, N-vinyl pyrrole, and trifluoroethyl methacrylate, and mixtures thereof; a process wherein the monomer is methyl methacrylate, styrene, trifluoroethyl methacrylate, or mixtures thereof, wherein the conductive additive is a carbon black, and where the amount of the conductive additive present is from about 10 to about 70 percent by weight, or from about 20 to about 50 percent by weight; a process wherein the initiator is selected from the group consisting of azo compounds, peroxides, and mixtures thereof, and where the amount of the initiator is from about 0.1 to about 20 percent by weight, or from about 0.5 to about 10 percent by weight of the monomer mixture; a process wherein the initiator is selected from the group consisting of 2,2'-azodimethylvaleronitrile, 2,2'-azoisobutyronitrile, azobiscyclohexanenitrile, 2-methylbutyronitrile, benzoyl peroxides, lauryl peroxide, 1-1-(t-butylperoxy)-3,3,5-trimethylcyclohexane, n-butyl-4,4-di-(t-butylperoxy) valerate, dicumyl peroxide, and mixtures thereof; a process wherein the crosslinking agent is selected from the group consisting of compounds having two or more polymerizable double bonds, and where the amount of the crosslinking agent is from about 0.1 to about 5 percent by weight, or from about 0.5 to about 3 percent by weight of the monomer mixture; a process wherein the crosslinking agent is selected from the group consisting of divinylbenzene, divinylnaphthalene, ethylene glycol diacrylate, ethylene glycol dimethylacrylate, divinyl ether, divinyl sulfite, divinyl sulfone, and mixtures thereof; a process wherein the chain transfer agent is selected from the group consisting of mercaptans and halogenated hydrocarbons, and wherein the chain transfer agent is selected in an amount of from about 0.01 to about 1 percent by weight, or from about 0.05 to about 0.5 percent by weight of the monomer mixture; and a process wherein the chain transfer agent is selected from the group consisting of laurylmercaptan, butylmercaptan carbon tetrachloride, carbon tetrabromide and mixtures thereof; and a developer comprised of conductive carrier particles and toner.

Examples of insulating carriers and which carriers possess a conductivity of, for example, from about $10^{-13}$ to about $10^{-18}$ (ohm-cm)$^{-1}$, and more specifically, from about $10^{-13}$ to about $10^{-15}$ (ohm-cm)$^{-1}$, as measured by placing 30 grams of carrier between two circular planar electrodes each of a diameter of 6 centimeters with a pressure of 15 kPa applied to the upper electrode, adjusting a gap between electrodes to 0.3 centimeter, applying a voltage of 10 volts and then 400 volts applied, measuring the current at both voltages, such that the conductivity is determined as a ratio of current to voltage times the ratio of gap to electrode area at each voltage, include carriers comprised of known carrier cores with a polymer coating thereover, wherein the polymer coating weight is, for example, from about 0.5 to about 3 weight percent, wherein the coating coverage on the core is, for example, from about 80 to about 100, and more specifically, from about 90 to about 100 percent and wherein the polymer is polymethylmethacrylate, polyvinylidenefluoride, polyethylene, copolyethylenevinylacetate; copolyvinylidenefluoride tetrafluoroethylene, polystyrene, polytetrafluoroethylene; polyvinyl chloride, polyvinylfluoride, polylbutylacrylate, copolybutylacrylate methacrylate, copolymethyl methacrylate dimethylaminoethylmethacrylate, copolyperfluorooctylethyl methacrylate methylmethacrylate, or mixtures thereof.

Examples of conductive carriers and which carriers possess, for example, a conductivity or resistivity of from about $10^{-5}$ to about $10^{-9}$ (ohm-cm)$^{-1}$, and more specifically, from about $10^{-5}$ to about $10^{-9}$ (ohm-cm)$^{-1}$ as measured by placing 30 grams of carrier between two circular planar electrodes with a pressure of 15 kPa applied to the upper electrode, adjusting a gap between electrodes to 0.3 centimeter, applying a voltage of 10 volts and then 400 volts applied, measuring the current at both voltages, such that the conductivity is determined as a ratio of current to voltage times the ratio of gap to electrode area at each voltage, include carriers comprised of known carrier cores with a polymer coating thereover, wherein the polymer coating contains a conductive component, such as a metal oxide, a conductive carbon black, and the like, and wherein the polymer coating weight is, for example, from about 1.25 to about 3 weight percent, wherein the coating coverage on the core is, for example, from about 50 to about 100, and more specifically, from about 75 to about 95 percent and wherein the polymer is polymethylmethacrylate, polyvinylidenefluoride, polyethylene, copolyethylenevinylacetate; copolyvinylidenefluoride tetrafluoroethylene, polystyrene, polytetrafluoroethylene; polyvinyl chloride, polyvinylfluoride, polylbutylacrylate, copolybutylacrylate methacrylate, copolymethyl methacrylate dimethylaminoethylmethacrylate, copolyperfluorooctylethyl methacrylate methylmethacrylate, or mixtures thereof. The conductive component is present in various amounts and is usually dispersed in the polymer coating, and which amounts are, for example, from about 25 to about 80, and more specifically, from about 35 to about 75 weight percent. Some specific examples of conductive components include carbon black, magnetite, conductive tin oxide, antimony-doped tin oxide, copper iodide, conductive zinc oxide, and conductive titanium dioxide.

The carrier polymer coating for the conductive carrier can contain as a conductive component, a conductive polymer which is commercially available, it is believed, including, for example, a conductive polyaniline, a doped (or complexed) form of polyaniline with an organic acid, preferably a sulfonic acid; the emeraldine salt of polyaniline, a green-black powder with no odor and commercially available as Versicon from Monsanto Company of St. Louis, Mo., reference U.S. Pat. No. 4,798,685, the disclosure of which is totally incorporated herein by reference; U.S. Pat. No. 5,069,820, the disclosure of which is totally incorporated herein by reference, and U.S. Pat. No. 5,278,213, the disclosure of which is totally incorporated herein by reference, and which illustrates aggregates of small primary particles of an average size of 0.1 to 0.2 micron with a bulk conductivity of 1 to 10 (ohm-cm)$^{-1}$; XICP-OS01, available from Monsanto Company, as the soluble form of the emeraldine salt of a polyaniline at a concentration of about 40 to about 60 percent (percent by weight), and typically 50 percent in a mixture of about 27 to about 40 percent butyl cellusolve and from about 0 to about 33 percent xylenes. The reported conductivities for the doped or complexed forms of the polyaniline polymer are, for example, 1 (ohm-cm)$^{-1}$ for the volume conductivity and about $10^{-2}$ to about $10^{-3}$ (ohm-square)$^{-1}$ for the surface conductivity as conducted on films with a thickness of 3 mils or approximately 75 microns. Further examples of conductive polymers that may be selected are XICP-OS06 available from Monsanto Company as the soluble form of the emeraldine salt of polyaniline at a concentration of about 9 to about 18 percent in a mixture of about 50 to about 70 percent tetrahydrofuran, about 6 to about 14 percent butyl cellusolve, about 0 to about 11 percent xylenes and about 7 to about 14 percent of dopants added to induce conductivity; Conquest XP 1000 a water based dispersion of polypyrrole and polyurethane, available from DSM Research, The Netherlands with a solids content of 19 to 21 percent and a reported conductivity of higher than about 0.2 (ohm-cm)$^{-1}$; Conquest XP 1020 the dry conductive powder of the aforementioned material with a Minimum Film Forming Temperature (MFT) of 50° C., and a drying temperature being between about 60° C. and about 120° C.; Baytron a dark blue aqueous solution of 3,4-polyethylene dioxythiophene polystyrene sulfonate (PEDT/PSS) containing about 0.5 percent by weight of PEDT and about 0.8 percent by weight of PSS, available from Bayer Corporation, and wherein surface conductivities of $10^{-3}$ to $10^{-5}$ (ohm-square)$^{-1}$ or higher can be achieved with this material; CPUD II an aqueous conductive polyurethane dispersion that can form a conductive film with surface conductivities of $10^{-5}$ to $10^{-8}$ (ohm)$^{-1}$ at a voltage of 100 volts using a Series 900 Megohmer; dispersions of polyaniline in different binders available as Corrpassive lacquer systems, and more specifically, ORMECON™ CSN available as an anticorrosion coating, and wherein the specific conductivity of some highly conductive ORMECON™ lacquers can achieve values of up to 100 (ohm-cm)$^{-1}$; WPPY, available from Eeonyx Corporation, a proprietary composition of polypyrrole n water at a concentration of about 1 to about 6 percent solids and a reported bulk conductivity of about 0.01 to about 0.001 (ohm-cm)$^{-1}$ as measured according to the ASTM F84 and D257; intrinsically conductive polymer additives based on polypyrrole and polyaniline and available as Eeonomer by Eeonyx as thin layers of polypyrrole and polyaniline on the surface of carbon blacks and with conductivities of up to about 40 $(ohm\text{-}cm)^{-1}$; and Neste Conductive Polymers—NCP, available from Neste Oy Chemicals, as conductive polymer compositions based on polyaniline that can be solution or melt processed and can achieve conductivities of about 1 $(ohm\text{-}cm)^{-1}$.

For each of the insulating and conductive carriers there can be selected a mixture of polymer coatings, for example, not in close proximity in the triboelectric series wherein close proximity refers to the choice of the polymers selected as dictated by their position in the triboelectric series, therefore, for example, one may select a first polymer with a significantly lower triboelectric charging value than the second polymer. For example, the triboelectric charge of a steel carrier core with a polyvinylidenefluoride coating is about −75 microcoulombs per gram. However, the same carrier, with the exception that there is selected a coating of polymethylmethacrylate, has a triboelectric charging value of about 40 microcoulombs per gram. More specifically, not in close proximity refers to first and second polymers that are at different electronic work function values, that is the polymers are not at the same electronic work function value; and further, the first and second polymers are comprised of different components. Additionally, the difference in electronic work functions in embodiment between the first and second polymer is, for example, at least 0.2 electron volt, and preferably is about 2 electron volts; and moreover, it is known that the triboelectric series corresponds to the known electronic work function series for polymers, reference "Electrical Properties of Polymers", Seanor, D. A., Chapter 17, *Polymer Science,* A. D. Jenkins, Editor, North Holland Publishing (1972), the disclosure of which is totally incorporated herein by reference.

The percentage of each polymer present as the carrier coating mixture can vary depending on the specific components selected, the coating weight and the properties desired. Generally, the coated polymer mixtures contains from about 10 to about 90 percent of a first polymer, and from about 90 to about 10 percent by weight of a second polymer. Preferably, there are selected mixtures of polymers with from about 40 to about 60 percent by weight of a first polymer, and from about 60 to about 40 percent by weight of a second polymer.

There results, in accordance with aspects of the present invention, carrier particles of relatively constant conductivities, measured by the 2-probe current-voltage DC method of from about $10^{-9}$ to about $10^{-13}$ $(ohm\text{-}cm)^{-1}$, about $10^{-10}$ to about $10^{-12}$ $(ohm\text{-}cm)^{-1}$ at, for example, a voltage of about 10 and 400 Volts, applied to 30 grams of carrier between two circular planar electrodes of diameter 6 centimeters with a pressure of 15 kPa applied to the upper electrode, with a gap between electrodes of 0.3 centimeter, and wherein the carrier particles are of a triboelectric charging value of from about −80 to about 80 microcoulombs per gram, and more specifically, from about −60 to about 60 microcoulombs per gram as determined by a Faraday Cage, these parameters being dependent on the carrier coatings selected, and the percentage of each of the polymers used, and the conductive polymer.

Various suitable solid core carrier materials can be selected, inclusive of known porous cores. Characteristic core properties of importance include those that will enable the toner particles to acquire a positive or a negative charge, and carrier cores that will permit desirable flow properties in the developer reservoir present in the xerographic imaging apparatus. Also of value with regard to the carrier core properties are, for example, suitable soft magnetic characteristics that permit magnetic brush formation in magnetic brush development processes, and wherein the carrier cores possess desirable aging characteristics. By soft magnetic is meant, for example, a developer that develops an induced magnetic field only when exposed to an external magnetic field, and which field is immediately diminished when the external field is removed. Examples of carrier cores that can be selected include iron, iron alloys, steel, ferrites, magnetites, nickel, and mixtures thereof. Alloys of iron include iron-silicon, iron-aluminum-silicon, iron-nickel, iron-cobalt, and mixtures thereof. Ferrites include a class of magnetic oxides that contain iron as the major metallic component and optionally a second metallic component including magnesium, manganese, cobalt, nickel, zinc, copper, and mixtures thereof. Preferred carrier cores include ferrites containing iron, nickel, zinc, copper, manganese, and mixtures thereof, and sponge iron with a volume average diameter of from about 30 to about 100 microns, and preferably from about 30 to about 50 microns as measured by a Malvern laser diffractometer. Examples of monomers or comonomers which can be polymerized to form an insulating polymer on the carrier surface in an amount of, for example, from about 0.5 to about 10 percent, and preferably from about 1 to about 5 percent by weight of carrier core include vinyl monomers, such as styrene, p-chlorostyrene, vinyl naphthalene and the like; monocarboxylic acids and their derivatives, such as acrylic acid, methyl acrylate, ethyl acrylate, n-butyl acrylate, isobutyl acrylate, dodecyl acrylate, n-octyl acrylate, 2-chloroethyl acrylate, phenyl acrylate, methylalphachloracrylate, methacrylic acids, methyl methacrylate, ethyl methacrylate, butyl methacrylate, octyl methacrylate, acrylonitrile, methacrylonitrile, acrylamide and trifluoroethyl methacrylate, dicarboxylic acids having a double bond and their derivatives, such as maleic acid, monobutyl maleate, dibutyl maleate, unsaturated monoolefins such as ethylene, propylene, butylene and isobutylene; vinyl halides such as vinyl chloride, vinyl bromide, vinyl fluoride; vinyl esters such as vinyl acetate, vinyl propionate, vinyl benzoate and vinyl butyrate; vinyl ethers, inclusive of vinyl methyl ether, vinyl isobutyl ether and vinyl ethyl ether; vinyl ketones inclusive of vinyl methyl ketone, vinyl hexyl ketone and methyl isopropenyl ketone; vinylidene halides such as vinylidene chloride and vinylidene chlorofluoride; N-vinyl compounds such as N-vinyl indole and N-vinyl pyrrolidene; fluorinated monomers such as pentafluoro styrene, allyl pentafluorobenzene and the like, other suitable known monomers, and mixtures thereof.

Toners can be admixed with the carrier to generate developers. As one toner resin there can be selected the esterification products of a dicarboxylic acid and a diol comprising a diphenol, reference U.S. Pat. No. 3,590,000, the disclosure of which is totally incorporated herein by reference, reactive extruded polyesters, such as those illustrated in U.S. Pat. No. 5,227,460, the disclosure of which is totally incorporated herein by reference, and the like. Specific toner resins include styrene/methacrylate copolymers; styrene/butadiene copolymers; polyester resins obtained from the reaction of bisphenol A and propylene oxide; and branched polyester resins resulting from the reaction of dimethylterephthalate, 1,3-butanediol, 1,2-propanediol and pentaerythritol. Other toner resins are illustrated in a number of U.S. patents including some of the patents recited hereinbefore.

Generally, from about 1 part to about 5 parts by weight of toner are mixed with from about 10 to about 300 parts by weight of the carrier particles.

Numerous well known suitable colorants, such as pigments or dyes can be selected as the colorant for the toner including, for example, cyan, magenta, yellow, red, blue, carbon black, nigrosine dye, lamp black, iron oxides, magnetites, and mixtures thereof. The colorant, which is preferably carbon black, should be present in a sufficient amount to render the toner composition highly colored. Thus, the colorant particles can be present in amounts of from about 3 percent by weight to about 20, and more specifically, from about 3 to about 12 weight percent or percent by weight, based on the total weight of the toner composition, however, lesser or greater amounts of colorant particles can be selected. Colorant includes pigment, dye, mixtures thereof, mixtures of pigments, mixtures of dyes, and the like.

When the colorant particles are comprised of magnetites, which are a mixture of iron oxides ($FeO.Fe_2O_3$) including those commercially available as MAPICO BLACK, they are usually present in the toner composition in an amount of from about 10 percent by weight to about 70 percent by weight, and preferably in an amount of from about 20 percent by weight to about 50 percent by weight.

The resin particles are present in a sufficient, but effective amount, thus when 10 percent by weight of pigment, or colorant such as carbon black is contained therein, about 90 percent by weight of resin is selected. Generally, the toner composition is comprised of from about 85 percent to about 97 percent by weight of toner resin particles, and from about 3 percent by weight to about 15 percent by weight of colorant particles.

The developer compositions can be comprised of thermoplastic resin particles, carrier particles and as colorants, magenta, cyan and/or yellow particles, and mixtures thereof. More specifically, illustrative examples of magentas include 1,9-dimethyl-substituted quinacridone and anthraquinone dye identified in the color index as CI 60720, CI Dispersed Red 15, a diazo dye identified in the color index as CI 26050, CI Solvent Red 19, and the like. Examples of cyans include copper tetra-4(octaecyl sulfonamido)phthalocyanine, X-copper phthalocyanine pigment listed in the color index as CI 74160, CI Pigment Blue, and Anthrathrene Blue, identified in the color index as CI 69810, Special Blue X-2137, and the like; while illustrative examples of yellows are diarylide yellow 3,3-dichlorobenzidene acetoacetanilides, a monoazo pigment identified in the color index as CI 12700, CI Solvent Yellow 16, a nitrophenyl amine sulfonamide identified in the color index as Foron Yellow SE/GLN, CI Dispersed Yellow 33, 2,5-dimethoxy-4-sulfonanilide phenylazo-4'-chloro-2,5-dimethoxy aceto-acetanilide, permanent yellow FGL, and the like. The colorants, which include pigments, mixtures of pigments, dyes, mixtures of dyes, mixtures of dyes and pigments, and the like, are generally present in the toner composition in an amount of from about 1 weight percent to about 15 weight percent based on the weight of the toner resin particles.

For further enhancing the positive charging characteristics of the developer compositions illustrated herein, and as optional components there can be incorporated therein known charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; metal complexes, E-88™, naphthalene sulfonates, quaternary ammonium compounds; and other similar known charge enhancing additives. These additives are usually incorporated into the toner or carrier coating in an amount of from about 0.1 percent by weight to about 20, and preferably from about 1 to about 7 weight percent by weight.

Examples of imaging members selected for the imaging processes illustrated herein are selenium, selenium alloys, and selenium or selenium alloys containing therein additives or dopants such as halogens. Furthermore, there may be selected organic photoreceptors illustrative examples of which include layered photoresponsive devices comprised of transport layers and photogenerating layers, reference U.S. Pat. Nos. 4,265,990; 4,585,884; 4,584,253, and 4,563,406, the disclosures of which are totally incorporated herein by reference, and other similar layered photoresponsive devices. Examples of generating layers are trigonal selenium, metal phthalocyanines, perylenes, titanyl phthalocyanines, metal free phthalocyanines and vanadyl phthalocyanines. As charge transport molecules there can be selected, for example, the aryl diamines disclosed in the '990 patent. Also, there can be selected as photogenerating pigments, squaraine compounds, thiapyrillium materials hydroxy gallium phthalocyanine, and the like. These layered members are conventionally charged negatively thus usually requiring a positively charged toner. Other photoresponsive members may include pigments of polyvinylcarbazole 4-dimethylamino benzylidene, benzhydrazide; 2-benzylidene-aminocarbazole, 4-dimethamino-benzylidene, (2-nitro-benzylidene)-p-bromoaniline; 2,4-diphenyl-quinazoline; 1,2,4-triazine; 1,5-diphenyl-3-methyl pyrazoline 2-(4'-dimethylaminophenyl)-benzoaxzole; 3-aminocarbazole, polyvinyl carbazole-trinitrofluorenone charge transfer complex; and mixtures thereof.

Moreover, the developer compositions of the present invention are particularly useful in electrostatographic imaging processes and apparatuses wherein there is selected a moving transporting means and a moving charging means; and wherein there is selected a deflected flexible layered imaging member, reference U.S. Pat. Nos. 4,394,429 and 4,368,970, the disclosures of which are totally incorporated herein by reference, and color, other than black, imaging and digital systems and processors. Images obtained with the developer composition of the present invention in embodiments possessed acceptable solids, excellent halftones and desirable line resolution, with acceptable or substantially no background deposits.

When resin coated carrier particles are prepared by the polymerization process of the present invention, the majority, that is over about 90 percent of the coating materials, such as polymer or polymers, are fused to the carrier surface thereby reducing the number of toner impaction sites on the carrier material. Additionally, there can be achieved with the process of the present invention, independent of one another, desirable triboelectric charging characteristics and conductivity values; that is for example, the triboelectric charging parameter is not primarily dependent on the carrier coating weight as is believed to be the situation with the process of U.S. Pat. No. 4,233,387, wherein an increase in coating weight on the carrier particles may function to also permit an increase in the triboelectric charging characteristics. Specifically, therefore, with the carrier compositions and process of the present invention there can be formulated developers with selected triboelectric charging characteristics and/or conductivity values in a number of different combinations.

The following Examples are being provided to further illustrate the present invention, it being noted that these Examples are intended to illustrate and not limit the scope of the present invention. Parts and percentages are by weight unless otherwise indicated.

Synthesis of Poly(Methyl Methacrylate) with Carbon Black (PMMA/CB)

To a 1 liter stainless steel Parr reactor were added 100.9 grams of methyl methacrylate (MMA), 538.2 grams of toluene, 7.23 grams of azobis(cyanohexane) (VAZO-88), 1.69 grams of benzoyl peroxide (LUCIDOL 75), and 152 grams of CONDUCTEX SC ULTRA carbon black obtained from Columbian Chemicals Company. The reactor was stirred with a pitch blade impeller at 230 rpm. The temperature was raised to 95° C. and held for 6 hours, followed by a temperature ramp of 0.14° C./minute to 110° C. The reactor was then cooled to room temperature, about 25° C. The reactor contents were poured into a foil tray and toluene was evaporated by air drying. The resulting dry material was ground with a coffee mill, and further dried in a vacuum dryer at 80° C. for 6 hours. The resulting polymethylmethacrylate/carbon black PMMA/CB copolymer (SOLP) was in the form of a coarse, sandy powder, which contained 59.6 weight percent carbon black, 39.8 weight percent polymer, and 0.6 weight percent volatiles as measured by thermogravimetric analysis (TGA).

To a 500 milliliter glass reactor were added 95 grams of MMA (methylmethacrylate), 0.6 gram of divinylbenzene and 45 grams of SOLP (from above). The resulting mixture was stirred with a pitch blade impeller at 200 rpm for 15 hours. To this mixture were added 4.1 grams of 2,2'-azobis (2,4-dimethylvaleronitrile) (VAZO-52), 2.1 grams of 2,2'-azobis-2-methyl-butanenitrile (VAZO-67), and 2.9 grams of benzoyl peroxide (LUCIDOL 75). Stirring was continued at 200 rpm for 2 hours. 150 Grams of this mixture were added to a mixture of 439.6 grams of deionized water, 15.4 grams of polyvinyl alcohol (AIRVOL 603), and 5 grams of potassium iodide. The mixture was stirred for 2 minutes at 200 rpm with a pitch blade impeller, followed by homogenizing at 800 rpm for 5 minutes with a Brinkmann Polytron. The resulting mixture was charged to a 1 liter Parr reactor and stirred at 230 rpm with a pitch blade impeller. The temperature was raised to 60° C. and held for 1.5 hours, and then raised to 80° C. and held for 1.5 hours. The reactor was then cooled to room temperature. The final slurry was added to a mixture of 406 grams of methanol and 46 grams of deionized water, centrifuged at 3,000 rpm for 3 minutes, and decanted. The resulting wet cake was washed three more times in this manner, followed by a final wash with 900 grams of deionized water. The final wet cake was vacuum dried at 80° C. and then ground with a coffee mill. The final product was a PMMA/CB (polymethyl methacrylate/carbon black) polymer in the form of a fine talc-like black powder. The composition of this polymer by TGA was 21.5 weight percent carbon black, 77.7 weight percent polymer, and 0.8 weight percent volatiles.

Carrier Comparative Example I

A semiconductive solution-coated carrier comprised of 1.55 weight percent of a copolymer of 86 percent perfluorooctylethyl methacrylate and 14 percent methyl methacrylate, 0.25 weight percent of VULCAN XC72 carbon black, and 0.2 percent melamine beads was evaluated for carrier conductivity. To measure the generated carrier conductivity utilizing the 2-probe current-voltage DC method, 30 grams of carrier were placed between two circular planar electrodes of diameter 6 centimeters with a pressure of 15 kPa applied to the upper electrode. The gap between electrodes was adjusted to 0.3 centimeter. A voltage of 10 volts was applied, and the current was measured; the voltage was then increased to 400 volts and the current was again measured. The conductivity was determined as a ratio of current to voltage times the ratio of gap to electrode area. Since the conductivity changes with voltage, it was calculated at both voltages. At 10 volts the carrier has a conductivity of $1.6\times10^{-12}$ $ohm^{-1}$ $cm^{-1}$, and at 400 volts a conductivity of $5.3\times10^{-11}$ $ohm^{-1}$ $cm^{-1}$. Thus, this carrier was semiconductive.

This carrier Example is provided primarily for reference as an example of a semiconductive carrier produced by the known addition of carbon black to a polymer coating.

Carrier Example II

A conductive carrier coated with poly(methyl methacrylate) and carbon black (PMMA/CB) was prepared as follows.

In the first step of the carrier coating process, 68 grams of PMMA/CB polymer prepared in Synthetic Example I and 4,540 grams of 35 micron volume median diameter ferrite core (obtained from PowderTech), were mixed on a Littleford M5R blender for 45 minutes at 145 rpm, thereby adhering the coating polymer onto the core particles. In the second step, the mixture was added at 4,500 grams per hour to a ZSK-30 extruder at 180° C. and with conveying screws rotating at 5 rpm, thereby causing the polymer to melt and fuse to the core. One carrier powder coating process used is described, for example, in U.S. Pat. No. 6,051,354, the disclosure of which is totally incorporated herein by reference. This resulted in a continuous uniform polymer coating on the core. The final product was comprised of a ferrite carrier core with a total of 3 percent of the above polymer by weight on the surface of poly(methyl methacrylate) with carbon black (21.5 weight percent carbon black and 77.7 weight percent polymer overall) determined in this and all following carrier Examples by dividing the difference between the weights of the fused carrier and the carrier core by the weight of the fused carrier.

The carrier conductivity was measured as in the above Carrier Example I. At 10 volts the carrier has a conductivity of $6.4\times10^{-9}$ $ohm^{-1}$ $cm^{-1}$, and at 400 volts a conductivity of $1.0\times10^{-7}$ $ohm^{-1}$ $cm^{-1}$. Thus, this carrier was conductive.

The conductive carrier of this Example was mixed in the following Example with an insulative carrier to form a semiconductive mixture of carriers.

Carrier Example III

An insulative carrier coated with poly(methyl methacrylate) was prepared as in Carrier Example II, except that 68 grams of poly(methyl methacrylate) were used in place of the poly(methyl methacrylate)/carbon black polymer. The final product was comprised of a carrier core with a total of 3 percent polymer by weight on the surface. The carrier conductivity was measured as in Comparative Carrier Example I. At 10 volts the carrier has a conductivity of $1.1\times10^{-15}$ $ohm^{-1}$ $cm^{-1}$, and at 400 volts a conductivity of $1.3\times10^{-14}$ $ohm^{-1}$ $cm^{-1}$. Thus, this carrier was insulative.

The insulative carrier of this Example was mixed in the following Example with a conductive carrier to form a semiconductive mixture of carriers.

Carrier Mixture Example IV

A carrier mixture comprised of 20 weight percent of conductive carrier and 80 weight percent of insulative carrier was prepared by mixing 10 grams of the conductive carrier of Carrier Example II and 40 grams of the insulative carrier of Carrier Example III on a Turbula mixer for 10 minutes. The conductivity of the resulting carrier mixture was $1.91\times10^{-13}$ $ohm^{-1}$ $cm^{-1}$ at 10 volts and $1.72\times10^{-11}$ $ohm^{-1}$ $cm^{-1}$ at 400 volts, and thus the mixture is considered semiconductive.

The carrier mixture of this Example illustrates that a mixture of insulative and conductive carriers generated a carrier mixture that is semiconductive with a controlled conductivity.

Carrier Mixture Example V

A carrier mixture comprised of 40 weight percent of conductive carrier and 60 weight percent of insulative carrier was prepared by mixing 20 grams of the conductive carrier of Carrier Example II and 30 grams of the insulative carrier of Carrier Example III on a Turbula mixer for 10 minutes. The conductivity of the resulting mixture was $8.81\times10^{-13}$ $ohm^{-1}$ $cm^{-1}$ at 10 volts and $4.24\times10^{-10}$ $ohm^{-1}$ $cm^{-1}$ at 400 volts, and was semiconductive.

The carrier mixture of this Example illustrates that a mixture of insulative and conductive carriers can generate a carrier mixture that is semiconductive with a controlled conductivity.

Carrier Mixture Example VI

A carrier mixture comprised of 60 weight percent of conductive carrier and 40 weight percent of insulative carrier was prepared by mixing 30 grams of the conductive carrier of Carrier Example II and 20 grams of the insulative carrier of Carrier Example III on a Turbula mixer for 10 minutes. The conductivity of the resulting mixture was $6.58\times10^{-10}$ $ohm^{-1}$ $cm^{-1}$ at 10 volts and $6.90\times10^{-9}$ $ohm^{-1}$ $cm^{-1}$ at 400 volts, and thus semiconductive.

The carrier mixture of this Example illustrates that a mixture of insulative and conductive carriers generated a carrier mixture that is semiconductive with a controlled conductivity.

Carrier Mixture Example VII

A carrier mixture comprised of 80 weight percent of conductive carrier and 20 weight percent of insulative carrier was prepared by mixing 40 grams of the conductive carrier of Carrier Example II and 10 grams of the insulative carrier of Carrier Example III on a Turbula mixer for 10 minutes. The conductivity of the resulting mixture was $8.49\times10^{-10}$ $ohm^{-1}$ $cm^{-1}$ at 10 volts and $1.91\times10^{-8}$ $ohm^{-1}$ $cm^{-1}$ at 400 volts, that is semiconductive at 10 volts and conductive at 400 volts.

The carrier mixture of this Example illustrates that a mixture of insulative and conductive carriers generated a carrier mixture that is semiconductive with controlled conductivity at 10 volts, and wherein the carrier mixture becomes conductive at 400 volts.

Developer Example VIII

Developer compositions were prepared by mixing the carrier of Example I with 5 weight percent of a cyan toner. The cyan toner was 5.6 microns in diameter size and was comprised of a copolymer of 82 weight percent styrene, 18 weight percent butylacrylate with 1.5 parts per hundred, a polypropylene wax obtained from Petrolite Chemicals of acrylic acid, 6 percent of Pigment Blue 15:3 and 8 percent of P725 wax, and with toner surface additives comprised of 1.14 percent hydrophobic 40 nanometers of titania, 0.60 percent of hydrophobic 50 nanometers of titania, 1.14 percent of 40 nanometers of hydrophobic fumed silica, and 2.22 percent of 120 nanometers of hydrophobic sol-gel silica.

For evaluation of the charging properties, the developers were conditioned overnight, about 18 hours, in A-zone or C-zone environmental conditions using 1.5 grams of toner and 30 grams of the carrier, charged by Turbula mixing for 2 minutes, then analyzed using a standard charge spectrograph. Admix was determined by adding 1.5 grams more toner and mixing on the Turbula for an additional 10 seconds. The admix quoted is the bottom end of the charge spectrograph trace, while the distribution index (DI) is the total width of the distribution divided by the peak value. All values are in millimeters of displacement from the zero dot at 100 volts/centimeter on the charge spectrograph.

For evaluation of print quality performance in a Tektronix Phaser 780 printer, 13 grams of the above toner and 260 grams of carrier were conditioned overnight, about 18 hours, in C-zone, then mixed on a Turbula mixer for 2 minutes. The charged developer was evaluated on the printer operating in C-zone. The acceptable developed mass per unit area, or DMA, was 0.4 $mg/cm^2$, the acceptable amount of carrier bead carry out, or BCO, was less than 10 carrier beads on a print, and the acceptable background on the photoreceptor corresponded to 5,000 toner particles/$cm^2$. Starvation was a print defect observed as a deletion zone at the boundary between a solid and a halftone area. The operating toner concentration latitude for the developer in the printer was determined as the toner concentration range where both the DMA and background were acceptable. Results for the performance of the solution coated semiconductive carrier of this Example are tabulated in Table 1. The operating window with this carrier was 5.2 percent.

The developer of this Example illustrates the functional performance observed for a developer prepared from a typical known semiconductive carrier.

Developer Example IX

Developer compositions were prepared as in Developer Example VIII, but with the conductive carrier of Carrier Example II. Results for the performance of the conductive carrier of this Example are tabulated in Table 1. The developer composition was not suitable for testing in the printer due to the very high conductivity of the carrier, which resulted in excessive currents, and an electrical short circuit from the developer to the photoreceptor.

The developer of this Example illustrates that the conductive carrier component utilized without the addition of the insulative carrier component produces a developer that is not that functional in a printer that requires a semiconductive carrier.

Developer Example X

Developer compositions were prepared as in Developer Example VIII, but with the insulative carrier of Carrier Example III. Results for the performance of the insulative carrier of this Example are tabulated in Table 1. The developer composition was not suitable for testing in the printer due to the very low conductivity of the carrier, which leads to inadequate toner development in the printer image.

The developer of this Example illustrates that the insulative carrier component utilized without the addition of the conductive carrier component produces a developer that is not fully functional in a printer that requires a semiconductive carrier.

Developer Example XI

Developer compositions were prepared as in Developer Example VIII, but with the mixture of insulative and conductive carrier of Carrier Example XII. Results for the performance of the semiconductive carrier mixture of this Example are tabulated in Table 1. All performance metrics for the semiconductive carrier mixtures are similar to the reference semiconductive solution coated carrier of Comparative Example 1. In particular, the conductivity and charging properties are very similar. The operating latitude of the semiconductive carrier mixture was 5 percent TC (toner concentration), equal to that of the solution-coated semiconductive carrier. Also, the operating latitude for the carrier mixture was observed at a lower TC than with the solution coated carrier, which is desirable as the higher operating TC of the solution coated carrier will result in increased print defects, such as starvation.

The developer of this Example, comprised of a carrier mixture of insulative and conductive carriers, illustrates that developers prepared from the semiconductive carrier mixtures of an insulative and conductive carrier are fully functional in a printer that requires a semiconductive carrier, and shows a performance that is superior to the performance observed with the semiconductive carrier Example illustrated in Developer Comparative Example VIII.

Table 1 summarizes the performance of selected developers in the Tektronix Phaser 780 printer with respect to various performance metrics, as described in detail in Developer Comparative Example VIII, Developer Example IX, Developer Example X, and Developer Example XI. The data shows that the developer comprised of the carrier mixture of Developer Example XI shows an operating window in the printer that is equivalent to the reference solution coated carrier of Developer Example VII.

TABLE 1

| | Performance of Developers | | | |
|---|---|---|---|---|
| | Developer Example IX | Developer Example X | Developer Example XI | Developer Comparative Example VIII |
| | Carrier Composition | | | |
| Performance Measurements | Conductive Carrier 1 | Insulative Carrier 2 | Semi-Conductive Carrier Mixture of Carrier Mixture Example V | Solution-Coated Semi-Conductive Carrier of Carrier Comparative Example I |
| Conductivity ohms$^{-1}$ cm$^{-1}$ | | | | |
| 10 V | 6.4E-09 | 1.1E-15 | 1.2E-11 | 1.6E-12 |
| 400 V | 1.0E-07 | 1.3E-14 | 4.2E-10 | 5.3E-11 |
| Charge Distribution | | | | |
| Peak q/d in fC/μm) (A-zone/C-zone) | −0.37 −0.47 | −0.36 −0.83 | −0.36 −0.68 | −0.33 −0.60 |
| Admix in fC/μm (A-zone/C-zone) | −0.16 −0.11 | −0.10 −0.18 | −0.08 −0.14 | −0.09 −0.18 |
| DI (A-zone/C-zone) | 0.22 0.25 | 0.25 0.17 | 0.27 0.16 | 0.35 0.31 |
| RH Peak | 0.73 | 0.44 | 0.54 | 0.55 |
| RH Admix | 0.71 | 0.55 | 0.6 | 0.5 |
| Tektronix Phaser 780 Printer Test | | | | |
| q/m in μC/g at 5% TC | Too Conductive for Print Test | Too Insulative for Print Test | 62 | 67 |
| q/m in μC/g at 10% TC | | | 40 | 33 |
| Acceptable BCO | | | >1.5% TC | >0.5% TC |
| Acceptable DMA | | | >2.2% TC | >6.8% TC |
| Acceptable Background | | | <7.5% TC | <12% TC |
| No starvation print defect | | | <5% TC | <5% TC |
| Operating Latitude from DMA to Background | | | 5% TC | 5.2 TC |

Other embodiments and modifications of the present invention may occur to those skilled in the art subsequent to a review of the information presented herein; these embodiments and modifications, equivalents thereof, substantial equivalents thereof, or similar equivalents thereof are also included within the scope of this invention.

What is claimed is:

1. Carrier comprised of a mixture of insulating carrier particles and conductive carrier particles, and wherein said conductive carrier particles contain a conductive component.

2. A carrier in accordance with claim 1 wherein said insulating or said conductive particles contain a coating.

3. A carrier in accordance with claim 1 wherein the conductive is a polyaniline.

4. A carrier in accordance with claim 1 wherein said insulating carrier has a conductivity of about $10^{-13}$ to about $10^{-18}$ (ohm-cm)$^{-1}$.

5. A carrier in accordance with claim 1 wherein said insulating carrier has a conductivity of about $10^{-13}$ to about $10^{-15}$ (ohm-cm)$^{-1}$.

6. A carrier in accordance with claim 1 wherein said conducting carrier has a conductivity of about $10^{-5}$ to about $10^{-9}$ (ohm-cm)$^{-1}$.

7. A carrier in accordance with claim 1 wherein said insulating carrier has a conductivity of about $10^{-13}$ to about $10^{-18}$ (ohm-cm)$^{-1}$, and said conducting carrier has a conductivity of about $10^{-5}$ to about $10^{-9}$ (ohm-cm)$^{-1}$.

8. A carrier in accordance with claim 1 wherein said conductive component is a conductive carbon black, optionally present in an amount of from about 20 to about 70 weight percent, or wherein said conductive component is a metal oxide, a metal, a conductive polymer, or a semiconductor component.

9. A carrier in accordance with claim 1 wherein said insulating carrier contains the polymer polymethylmethacrylate, and wherein said core is a ferrite, powdered iron, or magnetite.

10. A carrier in accordance with claim 1 wherein in said mixture there is present from about 5 to about 95 percent of said insulating carrier and from about 5 to about 95 percent of said conductive carrier, and wherein the total thereof is about 100 percent, or wherein in said mixture there is present from about 35 to about 75 percent of said insulating carrier and from about 35 to about 75 percent of said conductive carrier, and wherein the total thereof is about 100 percent.

11. A carrier in accordance with claim 1 wherein said resulting carrier is semiconductive, and wherein the conductivity of the resulting carrier has a value of about $10^{-9}$ to about $10^{-13}$ (ohm-cm)$^{-1}$.

12. A carrier in accordance with claim 1 wherein said carries contain a core of a diameter of from about 30 to about 100 microns.

13. A carrier in accordance with claim 1 wherein said polymer is polyvinylidenefluoride, polyethylene, polymethylmethacrylate, polytrifluoroethylmethacrylate, copolyethylene vinylacetate, copolyvinylidenefluoride, tetrafluoroethylene, polystyrene, tetrafluoroethylene, polyvinyl chloride, polyvinyl acetate, or mixtures thereof.

14. A developer comprised of the carrier of claim 1 and toner.

15. A carrier in accordance with claim 1 wherein said conductive component is carbon black.

16. Carrier comprised of a mixture of insulating coated carrier and a conductive coated carrier, and wherein said conductive coated carrier contains a polymer, and which polymer contains therein a conductive component.

17. A carrier in accordance with claim 16 wherein the mixture is a homogenous mixture.

18. A carrier in accordance with claim 16 wherein said insulating carrier is coated with a polymer, or wherein each of said carriers is coated with a mixture of polymers.

19. A carrier in accordance with claim 18 wherein the mixture is comprised of from about 2 polymers to about 7 polymers, and wherein said mixture is comprised of from 1 to about 4 insulating coated carriers, and from 1 to about 4 of conductive coated carriers.

20. A carrier in accordance with claim 16 wherein said insulating carrier has a conductivity of about $10^{-13}$ to about $10^{-15}$ (ohm-cm)$^{-1}$, and said conducting carrier has a conductivity of about $10^{-5}$ to about $10^{-9}$ (ohm-cm)$^{-1}$.

21. A carrier in accordance with claim 16 wherein said insulating carrier is comprised of a core and an insulating polymer thereover, and wherein optionally said insulating carrier has a conductivity of from about $10^{-13}$ to about $10^{-18}$ (ohm-cm)$^{-1}$, and wherein said conductive carrier is comprised of a core and a conductive polymer thereover, and wherein optionally said conductive carrier has a conductivity of from about $10^{-5}$ to about $10^{-9}$ (ohm-cm)$^{-1}$.

22. A carrier in accordance with claim 21 wherein said insulating polymer is polymethylmethacrylate, polyvinylidenefluoride, polyvinylfluoride, copolybutylacrylate methacrylate, copolyperfluorooctylethyl methacrylate methylmethacrylate, or polystyrene, and optionally wherein said coating contains a conductive filler component.

23. A carrier in accordance with claim 16 wherein said conducting carrier is comprised of a core, a polymer thereover and a conductive component.

24. A carrier in accordance with claim 16 wherein said carrier core for said insulating carrier is a ferrite and said carrier core for said conductive carrier is a magnetite.

25. A carrier in accordance with claim 16 wherein in said mixture there is present from about 40 to about 60 percent of said insulating carrier particles and from about 40 to about 60 percent of said conductive carrier particles, and wherein the total thereof is about 100 percent, and wherein said carrier contains a core that is coated with a polymer, and wherein said polymer encompasses from about 75 to about 100 percent of said core.

26. A carrier in accordance with claim 16 wherein each of said polymer coatings is present in a total amount of from about 0.5 to about 10 percent by weight of said carrier, or from about 1 to about 5 percent by weight of said carrier, and optionally wherein there results a semiconductive carrier with a conductivity of about $10^{-9}$ to about $10^{-13}$ (ohm-cm)$^{-1}$.

27. A carrier in accordance with claim 16 wherein said insulating coated carrier contains a polymer coating of polymethylmethacrylate, polystyrene, polytrifluoroethylmethacrylate, polyvinylidene fluoride, or mixtures thereof, or wherein said insulating coated carrier comprises a polymer coating comprised of a mixture of polymethylmethacrylate and polytrifluoroethylmethacrylate.

28. A process for the preparation of a carrier which comprises the mixing of a carrier with insulating characteristics and a carrier with conductive characteristics, and wherein said carriers are comprised of a core and a polymer thereover, and wherein one of said carriers contains dispersed in the polymer coating a conductive component.

29. A process in accordance to claim 28 wherein the monomer to form said polymer is selected from the group consisting of acrylic acid, methyl acrylate, ethyl acrylate, n-butyl acrylate, isobutyl acrylate, dodecyl acrylate, n-octyl acrylate, 2-chloroethyl acrylate, phenyl acrylate, methylalphachloracrylate, methacrylic acids, methyl methacrylate, ethyl methacrylate, butyl methacrylate, octyl methacrylate, acrylonitrile, methacrylonitrile and acrylamide; maleic acid, monobutyl maleate, dibutyl maleate; vinyl chloride, vinyl bromide, vinyl fluoride, vinyl acetate and vinyl benzoate; vinylidene chloride; pentafluoro styrene, allyl pentafluorobenzene, N-vinyl pyrrole, and trifluoroethyl methacrylate; and mixtures thereof; and wherein said monomer is present in an amount of from about 1 to about 5 percent by weight of said carrier core, or wherein the monomer is methyl methacrylate, styrene, trifluoroethyl methacrylate, or mixtures thereof, and wherein said monomer is present in an amount of from about 0.5 to about 10 percent by weight, or from about 1 to about 5 percent by weight of said carrier core, and where the amount of said conductive polymer additive present is from about 10 to about 70 percent by weight, or from about 20 to about 50 percent by weight of said monomer mixture, and wherein the initiator for polymerization of said monomer is selected from the group consisting of azo compounds, peroxides, and mixtures thereof, and where the amount of said initiator is from about 0.1 to about 20 percent by weight, or from about 0.5 to about 10 percent by weight of said monomer mixture.

30. Carrier consisting essentially of a mixture of insulating carrier particles and conductive carrier particles, and wherein said conductive carrier particles contain a conductive component.

31. A carrier comprised of a mixture of insulating carrier particles and conductive carrier particles, and wherein the insulating carrier particles are comprised of a core containing thereover a polymer, and wherein said conductive carrier particles are comprised of a core containing thereover a polymer, and wherein the polymer contains dispersed therein a conductive component.

32. A carrier in accordance with claim 31 wherein said conductive component is a polymer.

33. A carrier in accordance with claim 32 wherein said polymer is a polyaniline.

34. A carrier in accordance with claim 31 wherein said conductive component is polyacetylene, poly(p-phenylene) or poly(p-phenylene sulfide).

35. A carrier in accordance with claim 31 wherein said conductive component is polyvinylenephenylene, poly (vinylene sulfide), polypyrrole, or a polythiophene.

* * * * *